US005722544A

United States Patent [19]

Williams

[11] Patent Number: 5,722,544

[45] Date of Patent: Mar. 3, 1998

[54] MODULAR SHELVING SYSTEM

[76] Inventor: Martha Williams, 1330 W. 43rd St., Chicago, Ill. 60609

[21] Appl. No.: 425,906

[22] Filed: Apr. 20, 1995

[51] Int. Cl.[6] ..... A47F 5/00

[52] U.S. Cl. ..... 211/188; 211/133; 211/186; 108/107

[58] Field of Search ..... 211/188, 194, 211/133, 134, 186; 280/651; 108/56.1, 56.3, 107

[56] References Cited

U.S. PATENT DOCUMENTS

| | | | |
|---|---|---|---|
| 1,600,757 | 9/1926 | Foster | 211/133 |
| 3,788,241 | 1/1974 | Ravreby | 108/153 X |
| 4,474,416 | 10/1984 | Rogahn | 108/153 X |
| 4,558,647 | 12/1985 | Petersen | 108/107 |
| 4,593,826 | 6/1986 | Bustos | 211/187 |
| 4,930,643 | 6/1990 | Flum | 211/194 X |
| 4,940,150 | 7/1990 | Spengler | 211/133 X |
| 4,998,023 | 3/1991 | Kitts | 211/188 X |
| 5,158,187 | 10/1992 | Taub | 211/186 |
| 5,238,128 | 8/1993 | Stoddard | 211/188 |
| 5,433,326 | 7/1995 | Horian | 211/188 |

*Primary Examiner*—Robert W. Gibson, Jr.
*Attorney, Agent, or Firm*—Rudnick & Wolfe

[57] ABSTRACT

A modular shelving system includes at least two shelving units interconnected by support posts. Side and back panels can be attached to the support posts to define an enclosed compartment accessible from the front of the unit. An angled panel can be attached to the front to prevent any objects placed therein from easily falling out. Caster wheels can be attached to the bottom of the unit. Binding clips can be used to connect multiple base units together.

7 Claims, 3 Drawing Sheets

MODULAR SHELVING SYSTEM

BACKGROUND OF THE INVENTION

This invention generally relates to shelving units and, more particularly, to a modular shelving system including a number of individual components which can be assembled as desired for a variety of different uses.

Typically, shelving units are purchased by a customer who has a particular use in mind for the shelving unit. However, the needs of the customer can change over time requiring the customer to purchase different shelving units to accommodate other applications. Purchase of additional shelving units is expensive and using two different shelving units together can present an unattractive display. Therefore, an aesthetically pleasing, modular shelving system which can be readily adapted to a variety of uses with a minimum of cost is desired.

SUMMARY OF THE INVENTION

The present invention satisfies this desire by providing a modular shelving system comprising a number of individual components that can be assembled, as desired, to suit a customer's needs. Each of the shelves in a given application of the modular system is vertically separated by four posts. Side and back panels can be attached between adjacent shelves on the posts to define an enclosed compartment therebetween which is accessible from the front of the unit.

An angled panel can be attached to the front of the enclosed compartment to prevent any objects placed therein from easily falling out. For mobile shelving applications, caster wheels can be attached to the base unit's bottom shelf. A plurality of binding clips can be used to couple vertically adjacent ones of the side and back panels with additional structural integrity and can be used to bind multiple base units together.

DESCRIPTION OF A PREFERRED EMBODIMENT

Figure 1:
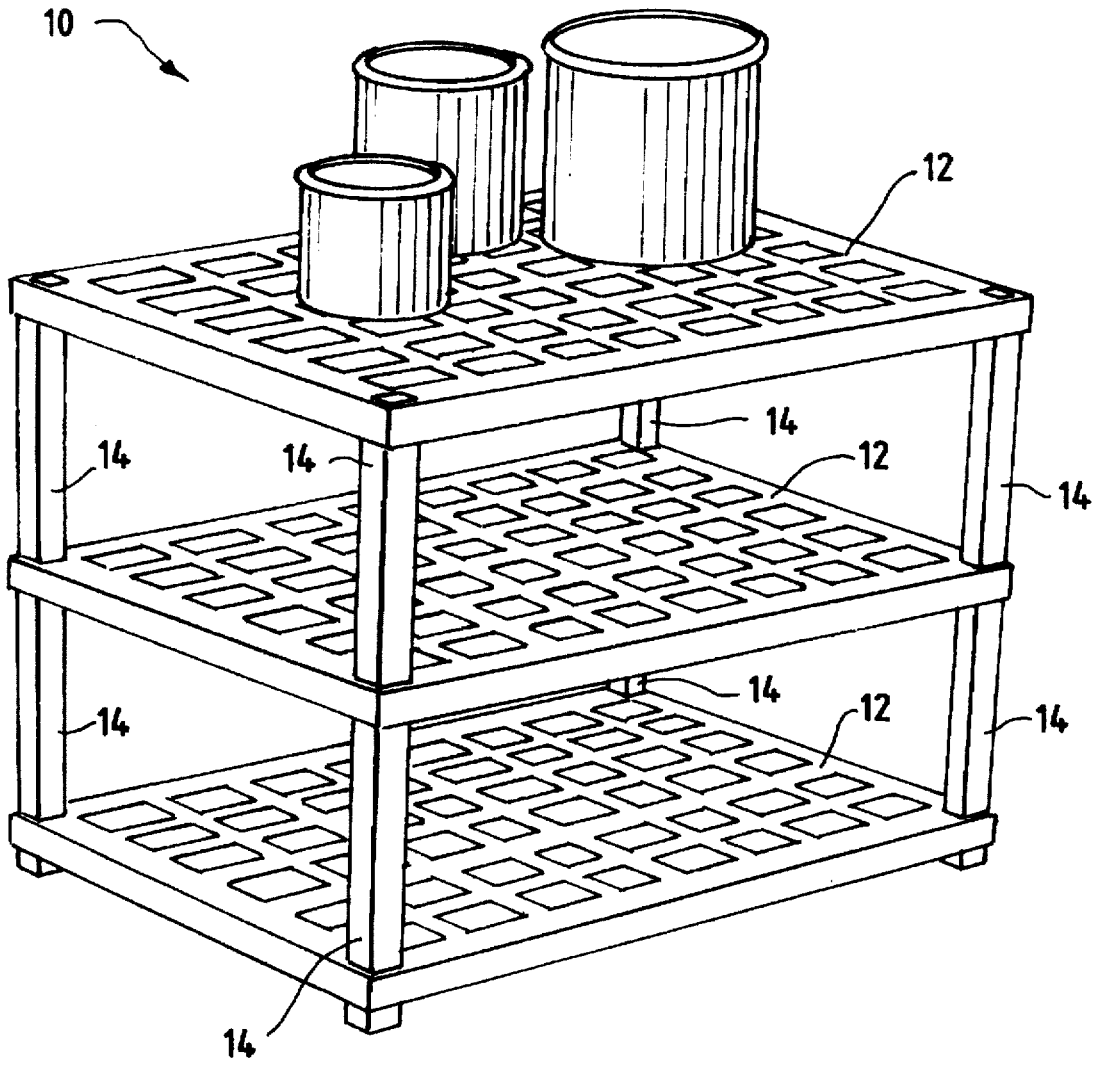
FIG. 1 is a perspective view of a base unit in a typical application of the modular shelving system of the present invention without the side, back or angled front panels.

Referring to FIG. 1, a perspective view of a base unit 10 is illustrated. Base unit 10 includes three rectangular shelves 12 which are separated by a plurality of support posts 14 to define shelving compartments therebetween.

Figure 2:
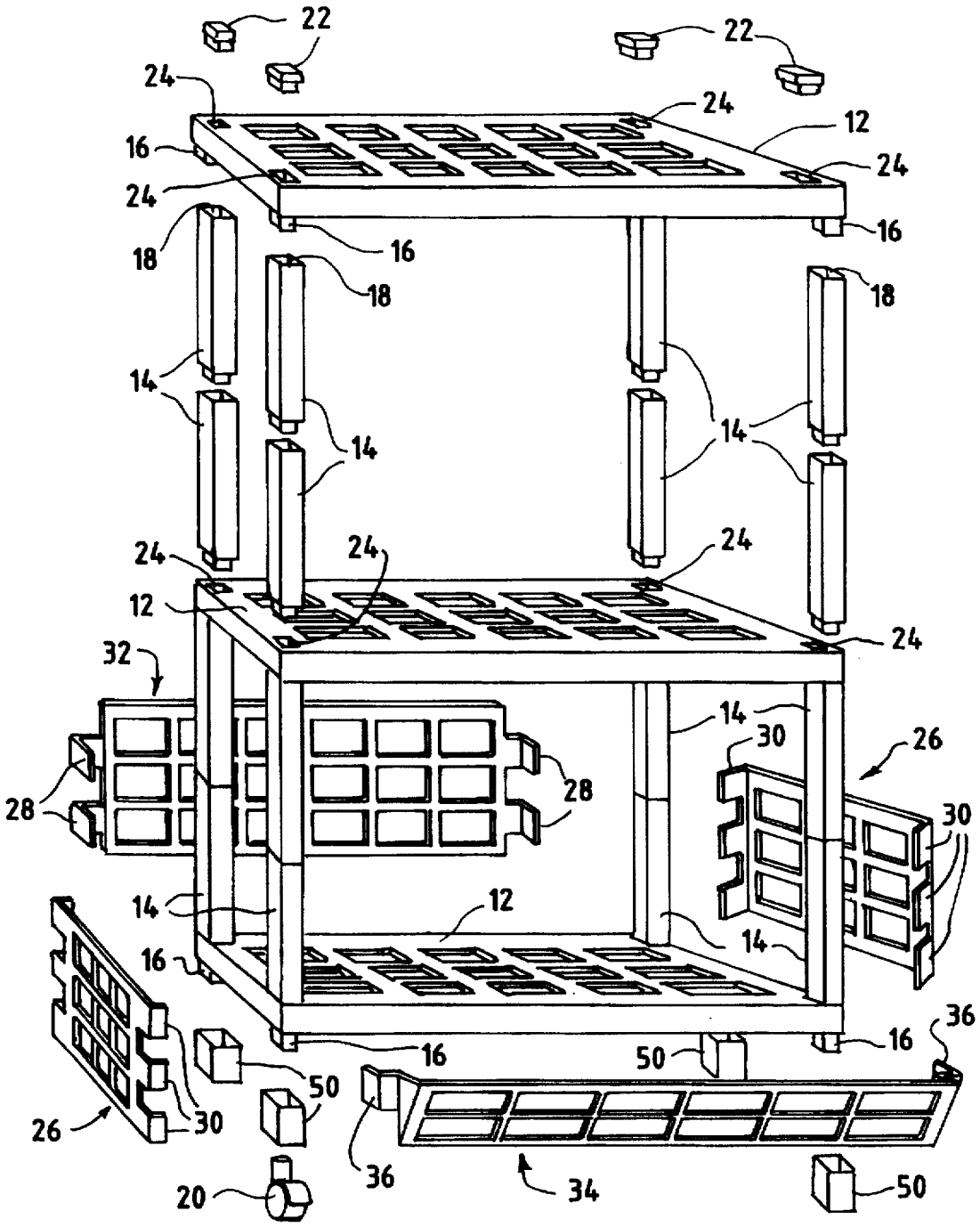
FIG. 2 is an exploded perspective view of all of the components of the base unit shown in FIG. 1.

FIG. 2 illustrates an exploded perspective view of all of the components that can be assembled to form various modifications of the base unit shown in FIG. 1 and how those components can be interconnected. Each of the shelves 12 includes four apertures 24 on its top face and four downwardly extending connecting tabs 16 on its bottom face which can be received in corresponding openings 18 in an end of a support post 14. The connecting tabs 16 can be used to support a shelf at a fixed point on the ground or can receive a caster wheel 20 for mobile shelving applications. Preferably, an adaptor 50 is attached to each of the connecting tabs 16 of the bottom shelf 12 for these purposes. For the uppermost shelf, a top cap 22 can be inserted into the apertures 24 to present a smooth surface.

To define a storage compartment between adjacent shelves, side panels 26 can be positioned on the sides of the base unit as illustrated in FIG. 2. Side panels 26 are secured to posts 14 by resilient connecting tabs 30 which also interlock with corresponding connecting tabs 28 of a back panel 32. An angled front panel 34 includes tabs 36 which can be inserted between the tabs 30 of side panels 26 so that items stored in a compartment between a pair of shelves can be retained as illustrated in FIG. 3.

Figure 3:
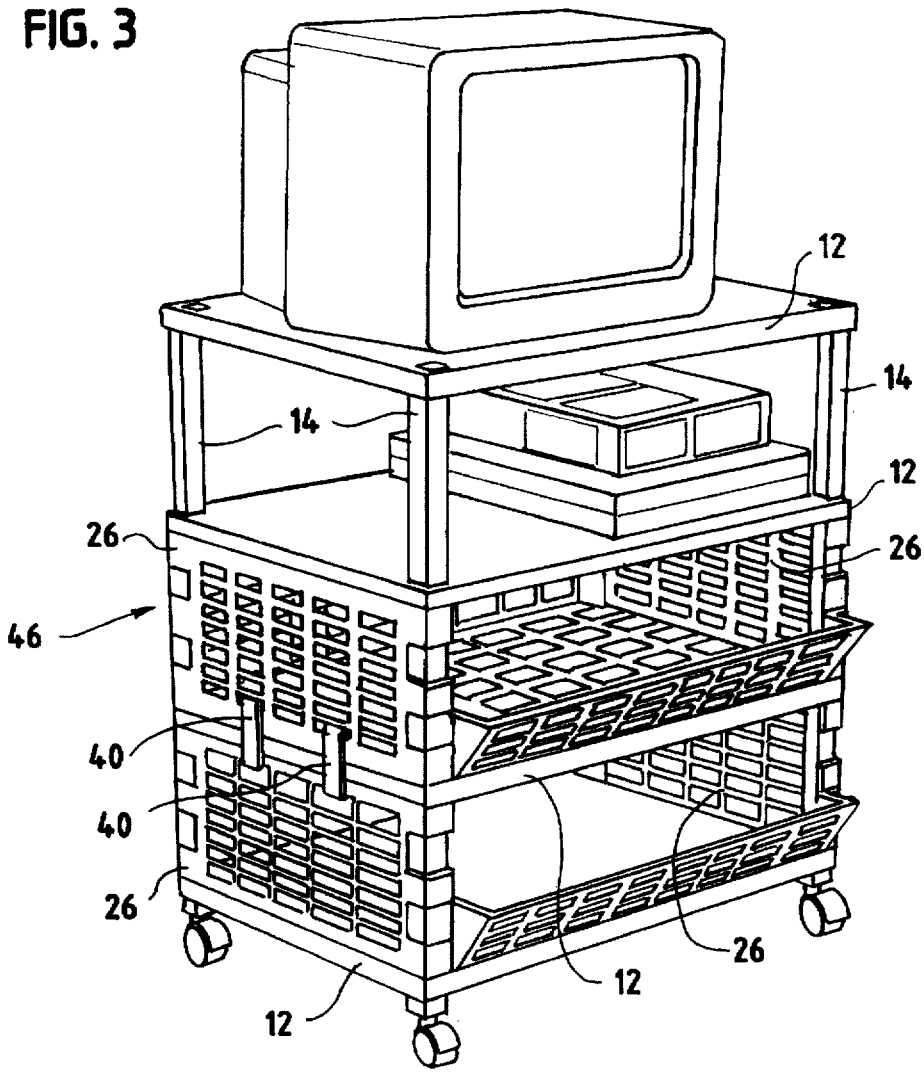
FIG. 3 is a perspective view that illustrates an application of the individual components of the modular shelving system shown in FIG. 2.
Figure 4:
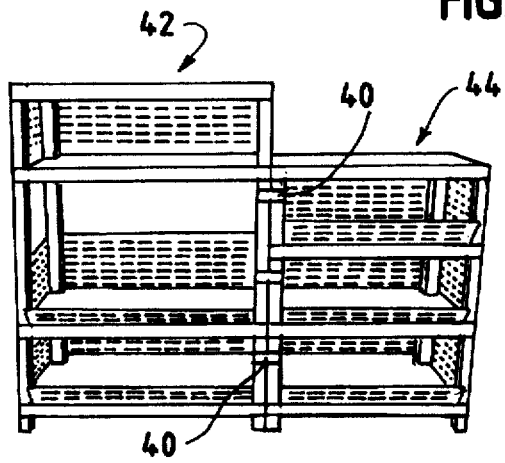
FIG. 4 is a perspective view that illustrates two modified base shelving units that are coupled together with binding clips.

FIGS. 3 and 4 illustrate the use of the resilient binding clips 40. Referring to FIG. 4, six binding clips 40 are used to join base units 42 and 44 together to form a side-by-side shelving system. In the embodiment FIG. 3, four binding clips 40 are used (two on each of the side panels 26) on each end of base unit 46 to enhance its structural integrity. Specifically, each clip 40 engages the upper side panel 26, shelf 12 and the lower side panel 26. The provision of the binding clips 40 permits base unit 46 to support heavier objects due to the enhanced structural integrity.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A modular shelving system for storing articles comprising:

a) at least three shelves;

b) means for interconnecting said shelves including a plurality of support posts to define storage spaces having four sides; and c) back and side panels enclosing three of the four sides of each of said storage spaces, the back and side panels each having opposing vertical end portions with a plurality of resilient connecting tabs disposed upon each of the vertical end portions, the tabs engaging the support posts and spaced from one another so as to permit the plurality of tabs on adjacent back and side panel vertical end portions to interengage one another.

2. The modular shelving system of claim 1, further comprising a plurality of binding clips for connecting two shelving systems together side-by-side, said binding clips being positioned on adjacent support posts of said shelving systems.

3. The modular shelving system of claim 1 further comprising an angled front panel having opposing vertical end portions with resilient connecting tabs disposed thereon, the tabs engaging two of said support posts and positioned upon the vertical end portions so as to permit the tabs of the angled front panel to interengage the plurality of tabs on adjacent vertical end portions of the side panels.

4. The modular shelving system of claim 1 further comprising a binding clip engaging one of each of a pair of vertically aligned side panels that are separated by a shelf unit.

5. The modular shelving system of claim 1 further comprising a binding clip engaging one of each of a pair of vertically aligned back panels that are separated by a shelf unit.

6. A modular shelving system for storing articles comprising:

a) a shelving unit defining at least one storage compartment which has four sides, said shelving unit including at least two shelves separated by a set of support posts;

b) at least one panel for enclosing one of said sides of said storage compartment; and c) resilient connecting tabs secured to the panel ends, each of said resilient connecting tabs having a free end so that the panel may be connected to the support posts, and disconnected therefrom, without disconnecting any of the support posts from any of the shelves.

7. A modular shelving system for storing articles comprising:

a) a shelving unit defining at least one storage compartment which has four sides, said shelving unit including at least two shelves separated by a set of support posts;

b) at least one panel for enclosing one of said sides of said storage compartment;

c) resilient connecting tabs secured to the panel ends for connecting the panel to the support posts; and d) a plurality of binding dips for connecting two shelving systems together side-by-side, said plurality of binding clips employed to secure adjacent support posts of said two shelving systems together.

* * * * *